US011540621B2

(12) United States Patent
Varch

(10) Patent No.: US 11,540,621 B2
(45) Date of Patent: Jan. 3, 2023

(54) BRUSH HEAD ARRANGEMENTS

(71) Applicant: KONINKLIJKE PHILIPS N.V., Eindhoven (NL)

(72) Inventor: Martin Varch, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 197 days.

(21) Appl. No.: 16/629,334

(22) PCT Filed: Jun. 20, 2018

(86) PCT No.: PCT/EP2018/066345
§ 371 (c)(1),
(2) Date: Jan. 8, 2020

(87) PCT Pub. No.: WO2019/011601
PCT Pub. Date: Jan. 17, 2019

(65) Prior Publication Data

US 2021/0137259 A1 May 13, 2021

Related U.S. Application Data

(60) Provisional application No. 62/531,383, filed on Jul. 12, 2017.

(51) Int. Cl.
*A46D 3/04* (2006.01)
*A46B 3/06* (2006.01)
(Continued)

(52) U.S. Cl.
CPC ..... *A46D 3/045* (2013.01); *A46B 3/06* (2013.01); *A46B 9/04* (2013.01); *A46D 3/005* (2013.01);
(Continued)

(58) Field of Classification Search
CPC ..... A46D 3/045; A46D 3/005
(Continued)

(56) References Cited

U.S. PATENT DOCUMENTS 4,988,146 A 1/1991 Weihrauch
5,823,633 A 10/1998 Weihrauch
(Continued)

FOREIGN PATENT DOCUMENTS

CA 2212721 A1 9/1996
DE 10221786 A1 11/2003
(Continued)

OTHER PUBLICATIONS

Computer generated English translation of DE 10 2005 029 366 A1, Schubnell, Jan. 2007. (Year: 2007).*
(Continued)

*Primary Examiner* — Laura C Guidotti

(57) ABSTRACT

A brush head (100) and a method of making a tuft spike (20) and a brush head with a plurality of tuft spikes. The brush head includes a matrix (30) having a plurality of receptacles (32) formed therein. A plurality of tuft spikes are each formed of a plurality of bristle strands (22) arranged in a tuft (21) having a free end (25) and a proximal end (23) inserted in a spike body (24). Each tuft spike is disposed in one of the receptacles of the matrix. A brush head neck (40) has a distal platen (42) that is connected to and at least partially encompassed in the matrix.

4 Claims, 4 Drawing Sheets

(51) Int. Cl.

| | |
|---|---|
| ***A46D 3/00*** | (2006.01) |
| ***A46B 9/04*** | (2006.01) |
| ***A46D 9/02*** | (2006.01) |
| *A46D 3/08* | (2006.01) |

(52) U.S. Cl.
CPC ..... *A46D 9/02* (2013.01); *A46B 2200/1066* (2013.01); *A46D 3/08* (2013.01)

(58) Field of Classification Search
USPC ..... 300/21
See application file for complete search history.

(56) References Cited

U.S. PATENT DOCUMENTS

| | | | | |
|---|---|---|---|---|
| 5,970,564 | A | 10/1999 | Inns | |
| 8,069,524 | B2 | 12/2011 | Kraemer | |
| 8,308,246 | B2 * | 11/2012 | Chung | A46B 9/04 300/21 |
| 10,568,724 | B2 | 2/2020 | Hess | |
| 10,849,423 | B2 | 12/2020 | Boucherie | |
| 2008/0168613 | A1 * | 7/2008 | Kraemer | A46B 9/12 15/167.1 |
| 2015/0164211 | A1 | 6/2015 | Hohlbein | |
| 2018/0132988 | A1 | 5/2018 | Dengler | |

FOREIGN PATENT DOCUMENTS

| | | | | |
|---|---|---|---|---|
| DE | 20301634 | U1 | 6/2004 | |
| DE | 102005029366 | A1 * | 1/2007 | A46B 3/04 |
| EP | 1194051 | B1 | 10/2003 | |
| EP | 1603429 | B1 | 8/2007 | |
| JP | H07155223 | A | 6/1995 | |
| WO | 2004082428 | A2 | 9/2004 | |
| WO | WO2011030939 | A1 | 3/2011 | |
| WO | 2015145340 | A1 | 10/2015 | |
| WO | 2016181291 | A1 | 11/2016 | |

OTHER PUBLICATIONS

International Search Report and Written Opinion, International Application No. PCT/EP2018/066345, dated Sep. 18, 2018.

* cited by examiner

BRUSH HEAD ARRANGEMENTS

This application is the U.S. National Phase application under 35 U.S.C. § 371 of International Application No. PCT/EP2018/066345, filed on 20 Jun. 2018, which claims the benefit of U.S. Provisional No. 62/531,383, filed 12 Jul. 2017. These applications are hereby incorporated by reference herein.

FIELD OF THE INVENTION

The present disclosure is directed generally to an improved brush head, and more particularly, to the arrangement, structure, securement, and resulting function of bristle tufts in a brush head.

BACKGROUND

Brush heads used with manual and power toothbrushes commonly have bristle tufts anchored within the brush head. The bristle tufts may be anchored in place using anchor-free tufting (AFT). Retention elements may be used in anchor-free tufting to secure respective bristle tufts within the brush head. Each bristle tuft is inserted into the hollow interior of a retention element, and the bristles in the retention element are then secured to a backing, forming the tooth brush head. In some toothbrushes, the retention elements and at least part of respective bristle tufts may be overmolded with a flexible material (e.g., a matrix) that joins the brush head components together In some instances, the retention elements are not firmly secured to the backing of the brush head, such that the retention element and bristle tuft or tuft strands are loose within the brush head. In other instances, overmolding a matrix over bristles in a retention element may result in a failure mode in which extrusion of the matrix occurs out through the retention element and/or between the bristles.

Accordingly, there is a need in the art for an improved method of securing the bristle tufts to the brush head using anchor-free tufting manufacturing methods, especially for use with power toothbrushes.

SUMMARY OF THE INVENTION

The present disclosure is directed to an inventive arrangement, structure, securement, and resulting function of bristle tufts in a brush head in an anchor-free tufting method. Various embodiments and implementations herein are directed to a brush head formed from a backing and spikes of bristle tufts overmolded together with a flexible material to form a brush head. Additional embodiments can include bristle tufts of varying lengths extending from the brush head, where the top/free portions of the bristle tufts are collectively arranged to form a non-planar functional brush surface.

Using the various embodiments and implementations herein, securement of the bristle tufts in the tuft spikes and securement of tuft spikes within the matrix can be substantially improved. These features also provide for improved and varying arrangements of bristles in the brush head. Further, using the various embodiments and implementations herein, improved and more complete teeth cleaning can be achieved based on, for example, the improved strength and flexibility of the brush head and of the bristle tuft and retention element collective assembly, and the variety of shapes, sizes and lengths of the bristle tufts.

Generally, in one aspect, a brush head assembly is provided. The brush head assembly includes a matrix having a plurality of receptacles formed therein; a plurality of tuft spikes, each formed of a plurality of bristle strands arranged in a tuft having a free end and a proximal end inserted in a spike body, each tuft spike disposed in one of the receptacles of the matrix; and a neck having a distal platen of which is connected to and at least partially embedded in the matrix.

In one embodiment, the matrix is made from a thermoplastic, a thermoplastic elastomer, or a combination including at least one of the foregoing. In one embodiment, the spike body and the bristle strands are formed of the same material or of different materials having a same or similar melting temperature.

In one embodiment, the spike body and the proximal end of the bristle strands are melted together to form each tuft spike. In one embodiment, the tuft spikes are injected into the matrix. In one embodiment, the tuft spikes are configured to be injected into the matrix pneumatically, hydraulically, or mechanically. In one embodiment, the receptacles each comprise a restriction and the spike bodies each comprise a retaining feature, the restriction having a first dimension that is less than a second dimension of the retaining feature, such that interference between the restriction and the retaining feature prevent disengagement of the tuft spikes after injection. In one embodiment, the receptacles each comprise a cavity, having a third dimension greater than the first dimension, each configured to receive the retaining feature of the spike body during injection.

Generally, in one aspect, a method for manufacturing a tuft spike is provided. The method includes molding a plurality of spike bodies in a mold; inserting a plurality of bristle strands arranged as a tuft through an opening of each spike body; adjusting a free end of each tuft, a proximal end opposite to the free end, or both the free end and the proximal end; and bonding the proximal end of the tuft to the spike body.

In one embodiment, the adjusting includes positioning the spike body in the mold, positioning a shape plate beneath the mold to define the free end of the bristle strands that extend out from the spike body. In one embodiment, the adjusting includes positioning the spike body in the mold, positioning a cutting plate on the mold at the proximal end of the tuft spikes, and cutting an excess portion of the bristle strands that extend above the cutting plate with a knife. In one embodiment, the bonding includes applying a temperature sufficient to at least partially melt the spike body and proximal end of the bristle strands together utilizing a melting pin, heated air, laser welding, or a combination including at least one of the foregoing.

Generally, in another aspect, a method for manufacturing a brush head assembly is provided. The method includes the steps of manufacturing a plurality of tuft spikes; forming a matrix around a platen of a neck of the brush head assembly; and injecting the tuft spikes into the matrix such that the proximal end of the tuft spikes are retained in the matrix with the free end of the tuft spikes external to the matrix.

In one embodiment, the forming includes forming the matrix with a plurality of receptacles and the injecting includes injecting the spike bodies of the tuft spikes into the receptacles. In one embodiment, each receptacle comprises a restriction having a first dimension and each spike body comprises a retaining feature having a second dimension larger than the first dimension, wherein the injecting includes inserting the retaining feature past the restriction.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects of the invention will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION OF EMBODIMENTS

The present disclosure describes various embodiments of an improved brush head for dental cleaning. More generally, Applicant has recognized and appreciated that it would be beneficial to provide a brush head formed from a backing and a matrix with a variety of spikes of bristle tufts disposed therein for improved adherence between the spikes of bristle tufts and the matrix. A particular goal of utilization of the embodiments of the present disclosure is the ability of the embodiments of the improved brush head. Another goal is to provide improved and more complete teeth cleaning.

In view of the foregoing, various embodiments and implementations are directed to an apparatus in which a brush head is formed from a matrix and includes a variety of tuft spikes are secured. In these embodiments, the brush head can also include bristle tufts of varying lengths extending from the brush head, where the top portions of the bristle tufts are collectively arranged to form a non-planar functional brush surface.

Figure 1:
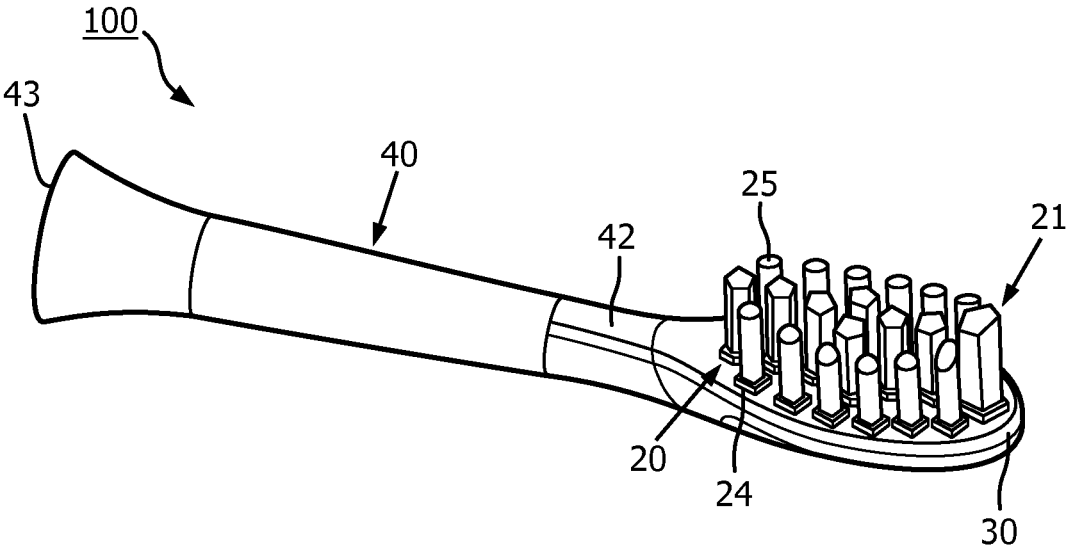
FIG. 1 is a perspective top view schematic representation of a brush head assembly in accordance with an embodiment.

Referring to FIG. 1, in one embodiment, a perspective assembled view representation of a brush head assembly 100 is provided. More particularly, the brush head assembly 100 may include, but is not limited to, a plurality of tuft spikes 20 embedded in a matrix 30 formed about and/or at a free end of a neck 40. That is, a distal portion 42 of the neck 40, which may be referred to as a platen, may be at least partially enclosed in and connected to the matrix 30. A proximal portion 43 of the neck 40 can be coupled to, or form a part of, any manual or powered toothbrush. For example, the neck 40 may be configured to be removably coupled to an actuator or drive shaft (not shown) of a powered oral care device (e.g., electric toothbrush) now known or to be developed.

Figure 2:
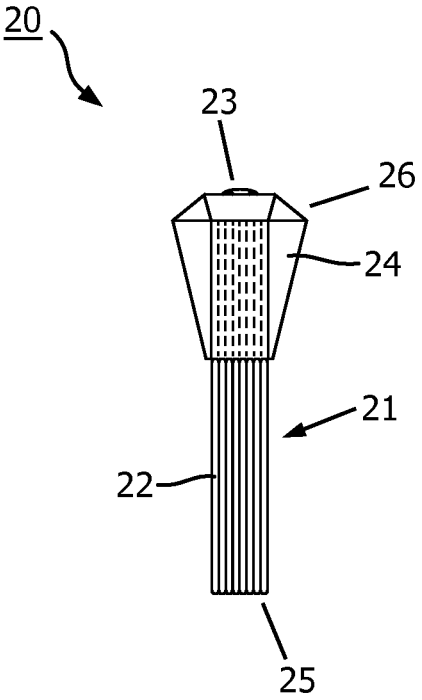
FIG. 2 is a side view schematic representation of a tuft spike in accordance with an embodiment.

As shown in more detail in FIG. 2, each of the tuft spikes 20 includes a tuft 21 of individual bristle strands or filaments 22, extending from and secured together at a proximal end 23 by a spike body 24. The bristle strands 22 may be formed from any suitable material, such as nylon or other polyamide (PA). Opposite the spike body 24, the tufts 21 terminate in a free end 25 (e.g., intended to be engaged against a user's teeth during brushing). Any number of the bristle strands 22 may be included in each tuft 21 and any number of the tuft spikes 20 may be included in the brush head 100.

The tuft spikes 20, tufts 21, strands 22, and spike bodies 24 can be of varying shapes, sizes, and/or configurations described or otherwise envisioned herein. For example, the strands 22 can be arranged in the tufts 21 in any shape, such as having a circular, triangular, square, pentagonal, hexagonal, heptagonal, octagonal, nonagonal, decagonal or other shape. The spike body 24 and the bristle strands 22 that form the tuft spikes 20 may be made from the same or compatible materials to achieve sufficient chemical bonding to form a closed sealed unit, e.g., during processes such as welding, melting, etc. However, dissimilar materials can be used if sufficient bonding between the materials can be achieved in another manner, such as via adhesives.

In one arrangement, the matrix 30 may comprise a compliant elastomeric material or any other material that is configured to exhibit elastic deformation during assembly of the brush head 100 according to the embodiments disclosed herein. According to an embodiment, the matrix 30 is made from a thermoplastic, flexible thermoplastic elastomer (TPE), or silicone rubber. The neck 40 is made from a material with a higher elastic modulus value than the matrix 30 (e.g., a stiff, resilient plastic). In other arrangements, the matrix 30 is made from a material that is stiffer than an elastomeric material as described above, but still capable of receiving and bonding with the spokes during assembly of the brush head 100 according to the embodiments disclosed herein.

Each spike body 24 includes a retaining feature 26 to assist in retaining the tuft spikes 20 within the matrix 30. The retaining feature 26 may result in the spike body 24 being wider toward, at, or near the proximal end 23. In the illustrated embodiment, the retaining feature 26 is formed from a generally conical shape of the spike body 24 that is wider toward the proximal end 23 and tapers down to a narrower shape toward the distal end 25. The retaining feature 26 may include one or more bulbs, bulges, knobs, protrusions, projections, flanges, or any other laterally or radially extending shape or geometry (e.g., extending generally transverse to the lengthwise direction of the strands 22) to help ensure retention.

Figure 3:
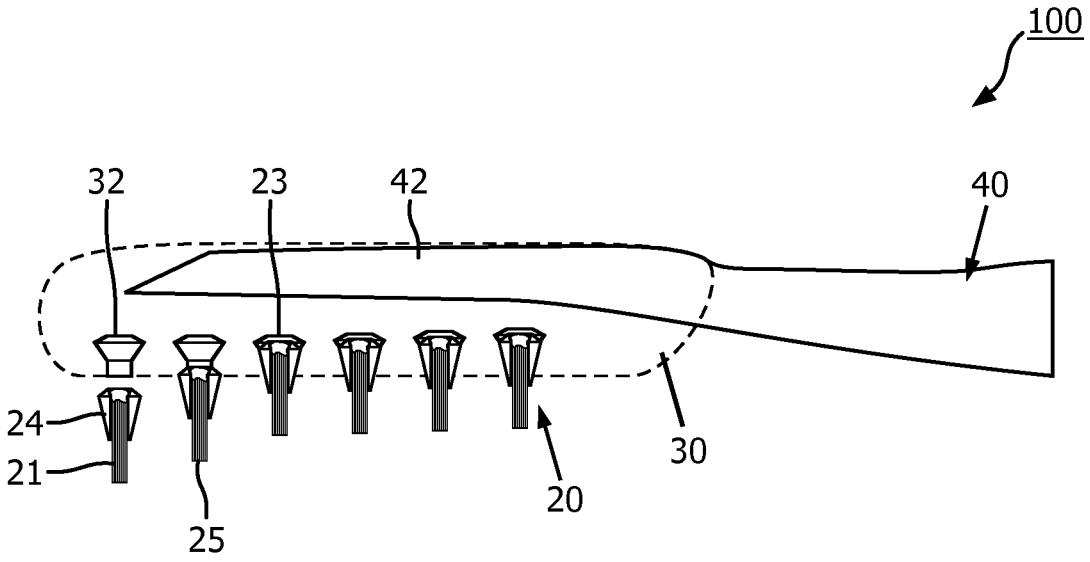
FIG. 3 is cutaway side view schematic representation of the brush head assembly of FIG. 1 in accordance with an embodiment.

Engagement of the tuft spikes 20 in the matrix 30 of the brush head 100 can be appreciated from FIG. 3 in which the matrix 30 is illustrated as partially cut away. In this embodiment, it can be seen that the matrix 30 includes a plurality of receptacles 32, each of which is configured to receive one of the tuft spikes 20. The receptacles 32 can be positioned, shaped, and arranged to receive corresponding sized and shaped tuft spikes in order to create a final bristled pattern for the brush head 100 when all of the tuft spikes 20 are inserted into the corresponding receptacles 32 of the matrix 30.

The tuft spikes 20 may be shot or injected into the matrix 30 using a compressed air device, or driven into the matrix 30 using some other method, such as a mechanical or hydraulic mechanism. In one embodiment, the tuft spikes 20 are glued into the brush head rather than, or in addition to, being injected into the matrix. In some embodiments, the tuft spikes 20 are injected directly from a mold (e.g., as discussed below with respect to FIGS. 5A-5E) into the matrix 30 without first being released from the mold. Alternatively, the matrix 30 can be injected in a liquid form and molded around the tuft spikes 20. Other embodiments of brush head assembly 100 are possible, including other methods of securing the tuft spikes 20 in the matrix 30. Advantageously, injecting the tuft spikes 20 into the matrix 30 after the matrix 30 has cured generally precludes the undesirable situation that may arise in overmolding one or more spikes with matrix material in which the material of the matrix extrudes out between the bristles, which may occur if overmolding of the matrix 30 were attempted with the bristles already in place.

Figure 4A:
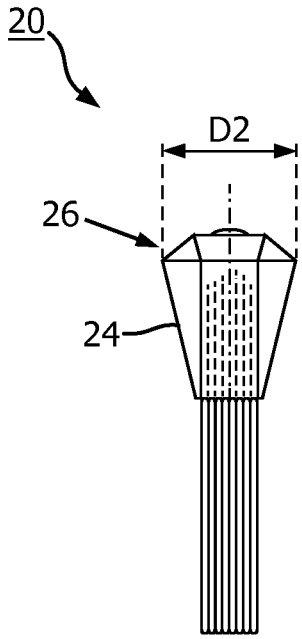
FIGS. 4A and 4 B are front views of the tuft spike of FIG. 2 shown adjacent a receptacle of the brush assembly of FIG. 3, respectively, in accordance with an embodiment.
Figure 4B:
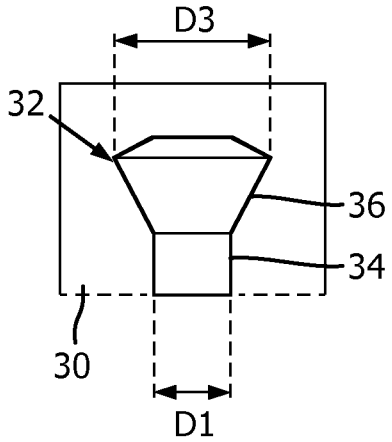

The receptacles 32 and the spike bodies 24 can be assembled such that it is difficult to remove the tuft spikes 20 from the matrix 30 once the spike bodies 24 are inserted into the respective receptacles 32. For example, as best seen in FIGS. 4A and 4B, the receptacles 32 may include a restriction 34 having a dimension D1 that is smaller than a corresponding dimension D2 of the retaining feature 26 of the tuft spikes 20 and a cavity 36 having a dimension D3 that is larger than the dimension D1 (but which may be larger, smaller, or the same as the dimension D2).

Once the retaining features 26 of the spike bodies 24 are inserted past the restrictions 34 (the elasticity of the material of the matrix 30 enabling the restrictions 34 to widen to receive the spike bodies 24 therethrough), the spike bodies 24 are received in the generally larger cavities 36. Once the spike bodies 24 are received in the cavities 36, the elasticity of the material of the matrix 30 biases the restrictions 34 back toward the dimension D1, thereby securing the spike bodies 24, having the relatively larger dimensions D2 of the retaining features 26, within the matrix 30. The dimension D3 may be approximately the same size as the dimension D2 to facilitate the spike bodies 24 to be firmly received, grabbed, and/or held within the matrix 30. The retaining forces exerted on the tuft spikes 20 via the elasticity of the material of the matrix 30 can be varied by changing the relative values of the dimensions D1, D2, and D3.

Figure 5A:
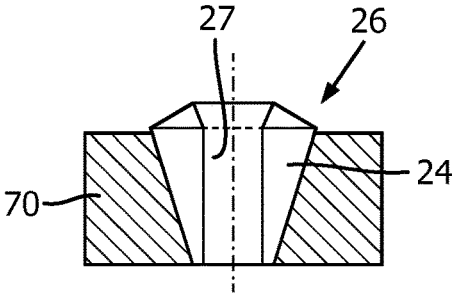
FIGS. 5A-5E are cross-sectional schematic representations of the steps in creating a bristle tuft spike in accordance an embodiment disclosed herein.
Figure 5B:
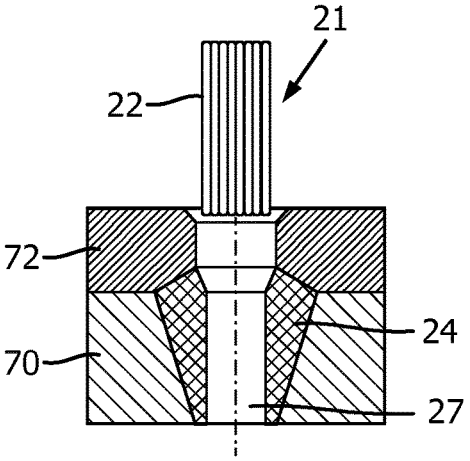

FIGS. 5A-5E detail steps to facilitate manufacture of the tuft spikes 20. The spike body 24 can be created using any conventional molding or forming technique, such as by using a mold 70 in accordance with FIG. 5A. It is to be appreciated that the mold 70, may have a portion extending down the length of the spike body 24 to create an opening or bore 27, which portion is not shown but may be included. Alternatively, the bore 27 may be formed after molding, e.g., by a milling operation. Once the spike body 24 is molded, the spike body 24, still in the mold 70, may be transferred to the next step as shown in FIG. 5B, in which a centering plate 72 is aligned with the bore 27 that extends longitudinally through the spike body 24. The bristle strands 22 are arranged in the tuft 21 as discussed above, and inserted together, guided by the centering plate 72, into the opening 27 of the spike body 24.

Figure 5C:
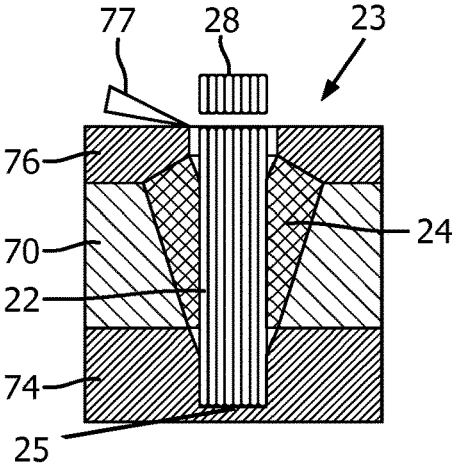

In FIG. 5C, a shape plate 74 is positioned beneath the mold 70 to define the length and surface of the bristle strands 22 that extend out from the end of the spike body 24 that will become the free end 25 of the tuft spikes 20. For example, different tufts may be contoured or have different lengths for providing different cleaning functions during brushing. Once the free end 25 of the bristles 22 are properly defined, contoured, and/or oriented, a cutting plate 76 may be positioned at the proximal end 23 of the tuft spikes 20. The cutting plate 76 forms a surface with respect to which a knife 77 can be used to trim excess material 28 of the bristles 22 extending above the cutting plate 76, thereby cutting the bristles 22 to a desired length.

Figure 5D:
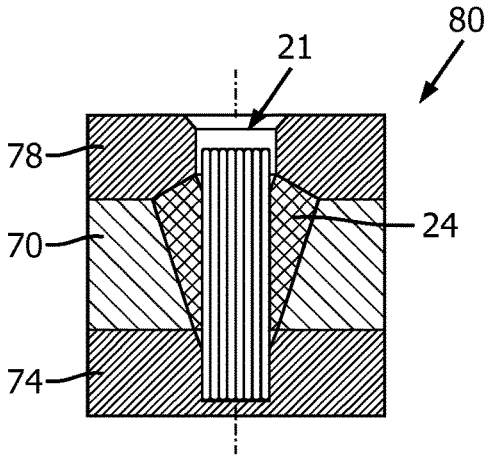
Figure 5E:
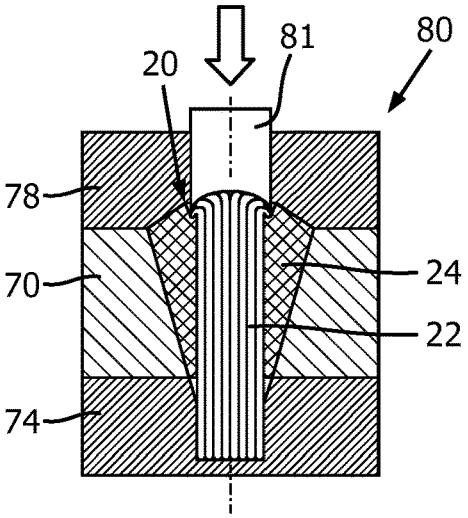

In FIG. 5D, the partially-formed tuft spike 20 is held in a melting unit 80, which may be formed by replacing the cutting plate 76 with a guiding plate 78. The guiding plate 78 may be the same component as the centering plate 72 if desired. The guiding plate 78 is arranged to guide a melting pin 81 to melt the bristles 22 and/or the spike body 24 together at the proximal end 23 to form the tuft spike 20 as shown in FIG. 5E. According to an embodiment, the heat applied by the melting pin 81 is sufficiently hot enough and/or applied sufficiently long enough to melt, at least partially, the spike body 24 with or to the bristle tuft 21. This aids in preventing the individual bristles 22 within bristle tuft 21 from escaping or moving around inside the spike body 24. It is to be appreciated that the melting unit 80 and the melting pin 81 provide merely one example of bonding, and that other welding or bonding techniques may be utilized, such as laser welding, heated air, adhesives, etc. The tuft spike 20 (e.g., after cooling or curing) is thereafter released in its final form.

Figure 6:
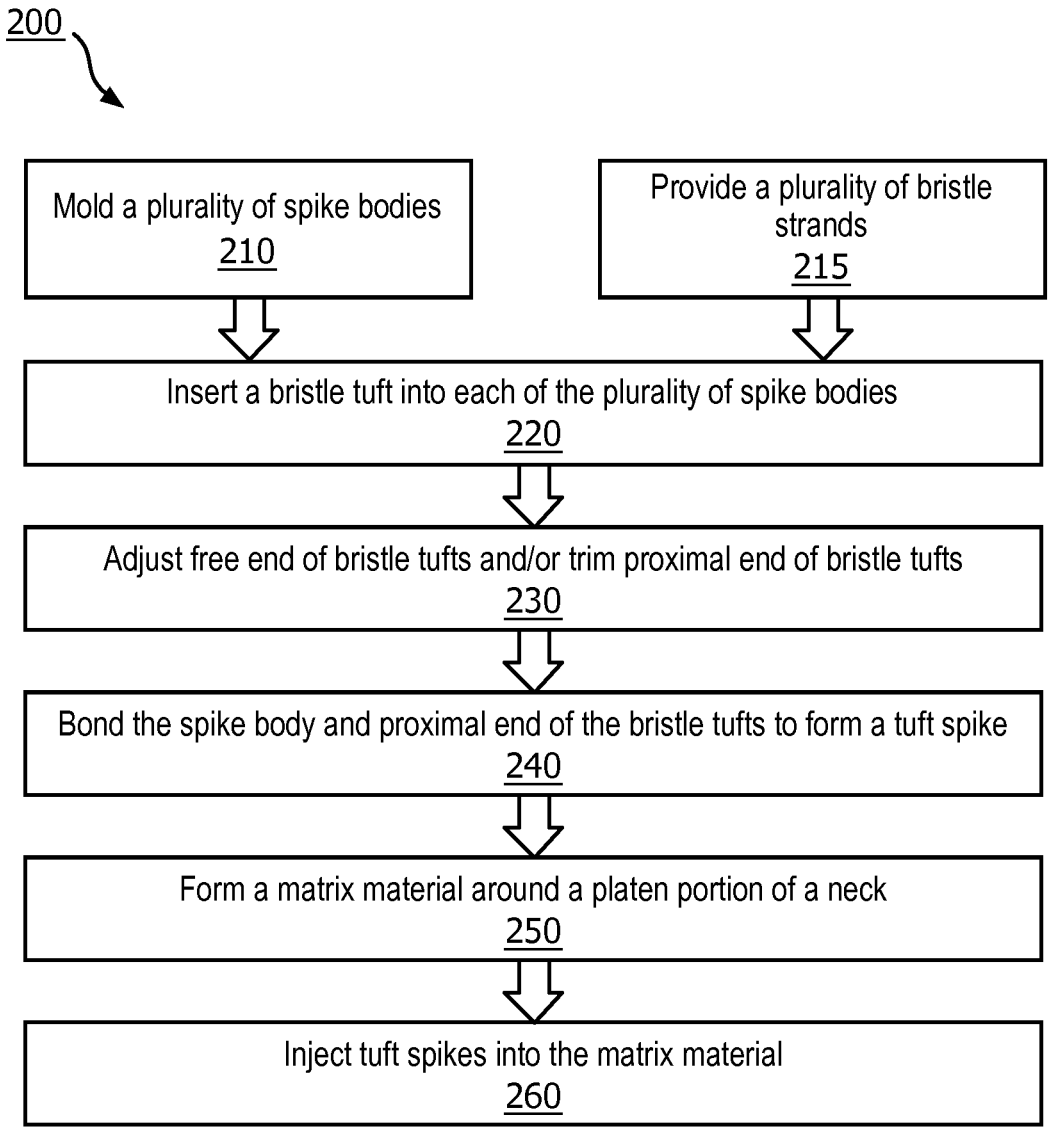
FIG. 6 is a flowchart of a method for manufacturing a brush head assembly with bristle tuft spikes retained within a matrix in accordance with an embodiment.

Referring to FIG. 6, in one embodiment, is a method 200 for manufacturing one or more of the various brush head assembly embodiments and implementations described or otherwise envisioned herein. In step 210 of the method 200, a plurality of spike bodies 24 are molded (e.g., in the mold 70). In step 215, a plurality of bristle strands 22 are formed or otherwise provided.

At step 220 of the method, the bristle strands are arranged in a tuft 21 aligned with an opening 27 that extends through the length of the spike body (e.g., via the centering plate 72), and inserted into the spike bodies 24.

At step 230 of the method 200, the length and surface of a free end 25 of the bristle strands is defined (e.g., via the shape plate 74 or other element positioned beneath the mold). Once the free end 25 of the bristles is properly defined and oriented, excess length is removed from the proximal end 23 of the bristles (e.g., via the cutting plate 76 and the knife 77).

At step 240, the inserted bristle strands are bonded in, with and/or to the corresponding spike body 24 at the proximal end 23 (e.g., by forming the melting unit 80 and using the melting pin 81 to melt the strands and/or spike body together, or using some other bonding technique such as laser welding, hot air, or adhesive bonding).

In step 250 of the method 200, a matrix 30 is formed, placed, or provided around a platen portion 42 of a neck 40 of the brush head 100. For example, the neck may be pre-molded and the matrix overmolded about the platen of the neck. The step 250 may include forming receptacles (e.g., the receptacles 32) in the matrix configured to receive the tuft spikes made in steps 210-240.

At step 260, the tuft spikes are injected into the matrix, e.g., into the aforementioned receptacles, such that the proximal end of the tuft spikes are retained in the matrix and the free end of the tuft spikes extend externally to the matrix. In this way, the free ends of the tuft spikes form the brushing surface for the brush head assembly.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A method for manufacturing a brush head assembly, the method comprising the steps of:

molding a plurality of spike bodies in a mold;

inserting a plurality of bristle strands arranged as a tuft through an opening of each spike body;

adjusting a free end of each tuft, a proximal end opposite to the free end, or both the free end and the proximal end; and bonding the proximal end of the tuft to the spike body;

forming a matrix around a platen of a neck of the brush head assembly, wherein the forming includes forming the matrix with a plurality of receptacles; and injecting the tuft spikes into the matrix such that the proximal end of the tuft spikes are retained in the matrix with the free end of the tuft spikes external to the matrix, wherein the injecting includes injecting the spike bodies of the tuft spikes into the receptacles, wherein each receptacle comprises a restriction having a first dimension and each spike body comprises a retaining feature having a second dimension larger than the first dimension, wherein the injecting includes inserting the retaining feature past the restriction.

2. The method of claim 1, wherein the adjusting includes positioning the spike body in the mold, positioning a shape plate beneath the mold to define the free end of the bristle strands that extend out from the spike body.

3. The method of claim 1, wherein the adjusting includes positioning the spike body in the mold, positioning a cutting plate on the mold at the proximal end of the tuft spikes, and cutting an excess portion of the bristle strands that extend above the cutting plate with a knife.

4. The method of claim 1, wherein the bonding includes applying a temperature sufficient to at least partially melt the spike body and proximal end of the bristle strands together utilizing a melting pin of a melting unit, heated air, laser welding, or a combination including at least one of the foregoing.

* * * * *